US008371364B2

(12) United States Patent
Braun et al.

(10) Patent No.: US 8,371,364 B2
(45) Date of Patent: Feb. 12, 2013

(54) COOLING BODY FOR A VOLTAGE REGULATOR

(75) Inventors: Horst Braun, Stuttgart (DE); Robert Goldschmidt, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 800 days.

(21) Appl. No.: 12/226,697

(22) PCT Filed: Apr. 26, 2007

(86) PCT No.: PCT/EP2007/054107

§ 371 (c)(1),
(2), (4) Date: Jul. 16, 2009

(87) PCT Pub. No.: WO2007/122263

PCT Pub. Date: Nov. 1, 2007

(65) Prior Publication Data

US 2010/0006272 A1 Jan. 14, 2010

(30) Foreign Application Priority Data

Apr. 26, 2006 (DE) ..... 10 2006 019 310

(51) Int. Cl.
*F28D 7/02* (2006.01)
*F28F 7/00* (2006.01)

(52) U.S. Cl. ..... 165/80.3; 165/185

(58) Field of Classification Search ..... 165/80.3, 165/41, 185; 361/704; 257/722
See application file for complete search history.

(56) References Cited

U.S. PATENT DOCUMENTS 2,131,929 A * 10/1938 Amme ..... 165/185
5,873,407 A * 2/1999 Wang et al. ..... 165/80.3
5,912,800 A 6/1999 Sammakia et al.
5,915,463 A 6/1999 Romero et al.
6,382,306 B1 * 5/2002 Hsu ..... 165/80.3
2003/0221814 A1 12/2003 Kamath et al.
2005/0045308 A1 * 3/2005 Wang et al. ..... 165/80.3

FOREIGN PATENT DOCUMENTS

| | | |
|---|---|---|
| DE | 90 17 681 | 7/1990 |
| DE | 42 31 122 | 7/1993 |
| DE | 44 13 723 | 11/1995 |
| DE | 197 04 226 | 8/1998 |
| DE | 10 2004 052 149 | 2/2006 |
| EP | 0 681 360 | 11/1995 |

OTHER PUBLICATIONS

International Search Report, PCT International Patent Application No. PCT/EP2007/054107, dated Aug. 21, 2007.

* cited by examiner

*Primary Examiner* — Allen Flanigan
*Assistant Examiner* — Jason Thompson
(74) *Attorney, Agent, or Firm* — Kenyon & Kenyon LLP

(57) ABSTRACT

A cooling body for the regulator of an electric machine, which regulator may be a voltage regulator of a DC generator of a vehicle, includes a heat exchange surface with an inflow region and an outflow region. A cooling air flow may be applied to the heat exchange surface during the operation of the electric machine. The cooling air stream impinges on the heat exchange surface in the inflow region and leaves the heat exchange surface from the outflow region. The heat exchange surface is shaped differently in the inflow region than in the outflow region. Because of the shape of the heat exchange surface, the direction in which the cooling air is applied is different compared to conventional surfaces.

8 Claims, 3 Drawing Sheets

Fig. 3
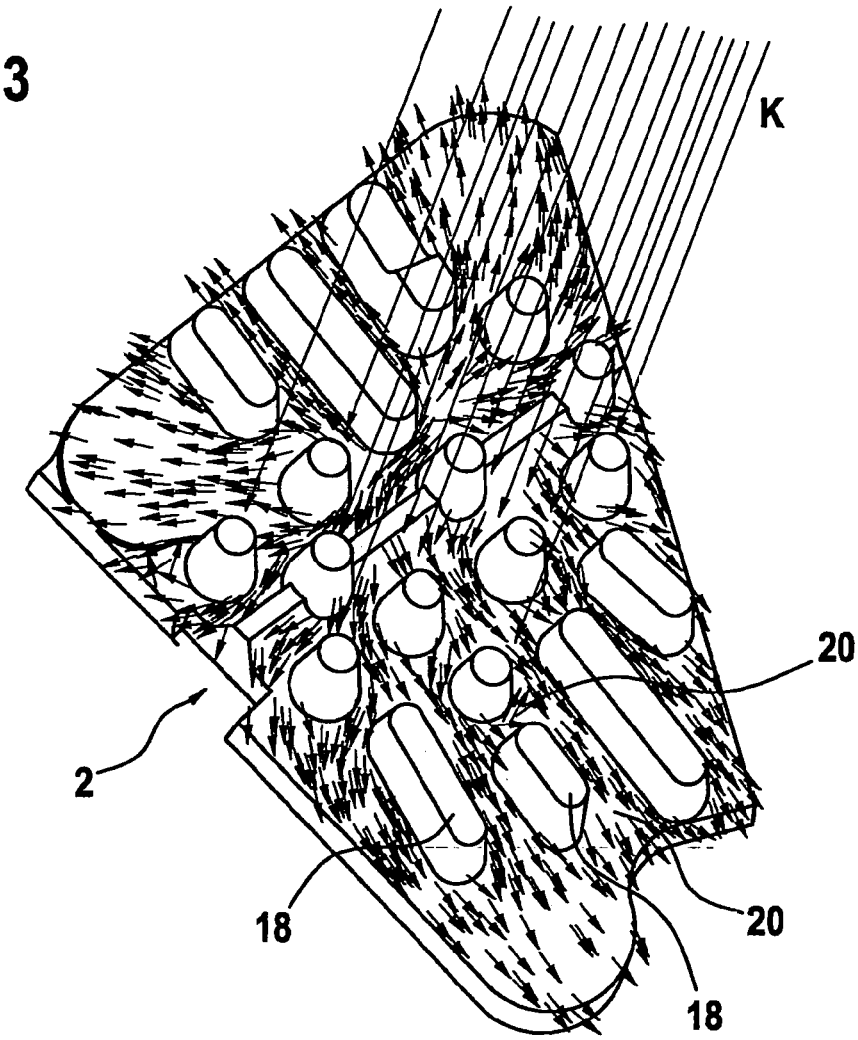
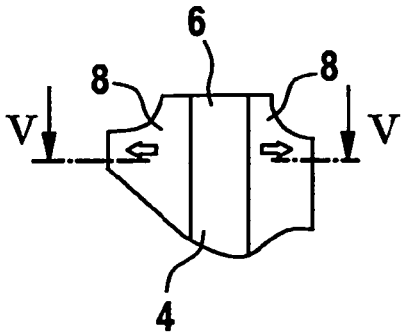
Fig. 4
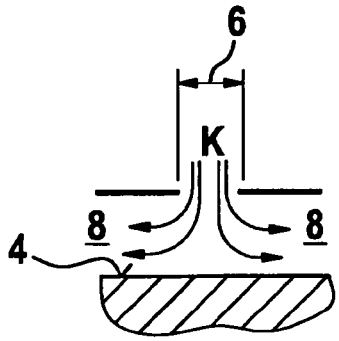
Fig. 5

COOLING BODY FOR A VOLTAGE REGULATOR

FIELD OF THE INVENTION

The present invention relates to a regulator having a cooling body (heat sink) for an electric machine, particularly a voltage regulator of a DC generator of a vehicle.

BACKGROUND INFORMATION

Regulators of electric machines, such as voltage regulator of a DC generator of a motor vehicle, are generally mounted in the vicinity of the electric machine; thus, they have to be cooled in order to avoid damage to heat-sensitive electronic components of the regulator resulting from the heat generated during the operation of the electric machine. For this reason, voltage regulators of motor vehicles mounted on the generator are provided with a cooling body made of a good heat conductive material on their side facing away from the generator, which, during the operation of the generator, has applied to it a cooling air stream from a cooling air fan driven by the generator. In order to improve the cooling performance, the cooling body has a plurality of smooth cooling ribs aligned generally in parallel to one another on its upper side, whose surfaces form a heat exchange surface, together with the surfaces in the interstices between the cooling ribs. This heat exchange surface is aligned, with respect to the cooling air stream, in such a way that the cooling air is conducted all the way through the interstices between the cooling ribs, generally parallel to the upper side of the cooling body, past the heat exchange surface. However, boundary layers form at the heat exchange surface which impair convective heat transmission, and thus the cooling effect.

SUMMARY

An object of the present invention is to provide a regulator having a cooling body that has an improved cooling effect.

To attain this object, a regulator having a cooling body is provided. This regulator has a cooling body that has the advantage of having a better cooling effect, and, at constant temperature and flow speed of the cooling air, it makes possible a temperature reduction by several degrees Kelvin on the inside of the regulator, and particularly in the regions that are at the highest temperature.

The different form and flow application to the heat exchange surfaces acts positively on the heat transfer between the heat exchange surface and the cooling air stream, particularly if, in a preferred embodiment of the present invention, the heat exchange surface, in the inflow region, includes one of the following: either a flow-against surface that is generally planar and aligned perpendicular to a main flow direction of the incoming cooling air, or a convexly arched upper side of a saddle-shaped elevation having at least two deflection surfaces that are aligned obliquely to the main flow direction of the incoming air. In this case, the cooling air flow is deflected by the flow-against surface or by the upper side of the elevation in the direction of the outflow region, where the cooling body, similarly to conventional cooling bodies, is preferably provided with protruding, rib-like projections, between which the cooling air is able to flow to an adjacent edge of the cooling body.

According to one preferred embodiment of the present invention, the inflow region is situated generally in the middle of the upper side of the cooling body that is provided with the heat exchange surface, whose lower side faces the regulator, while the outflow region either at least partially surrounds the inflow region or is situated on opposite sides of the inflow region.

A further preferred embodiment of the present invention provides that, within the inflow region, several individual pin-shaped or needle-shaped projections are situated that protrude over the flow-against surface and/or the elevation, whose surfaces form the heat exchange surface in the inflow region together with the flow-against surface and the upper side of the elevation in the inflow region. These pin-like or needle-like projections that protrude over the flow-against surface have the advantage that the incoming cooling air, even before its contact with the incoming flow surface or the upper side of the elevation, flows along the circumferential surfaces of the projections, and, in so doing, absorbs heat from the projections. But because of the pin-type or needle-type shape of the projections, they have relatively large circumferential surfaces around which the cooling air flows, but a relatively small end face that the cooling air flows against, so that the incoming cooling air is not deflected at the projections, or only slightly so, and the size of the flow-against surface or the upper side of the elevation is not noticeably decreased.

One particularly preferred embodiment of the present invention provides that at least a part of the pin-type or needle-type projections be situated at a distance from one another along the saddle-shaped elevation and/or on both sides of the saddle-shaped elevation, since this may be a favorable variant for the inflow region.

The saddle-shaped elevation, in cross section, has a ratio of height to width at the base of approximately 0.8 to 1.2, in this instance, while the ratio of width of the base to width of the apex amounts to about 2.0 to 4.0.

The pin-shaped or needle-shaped projections expediently have a frustoconically tapered shape starting at their base, in which the ratio of height to base diameter amounts to about 1.0 to 2.5, while the ratio of base diameter to head diameter amounts to about 1.8 to 2.2.

In principle, however, the flow-against surface or the saddle-shaped elevation in the inflow region may also be empty, that is, have no protruding projections. By contrast, using rib-like projections in the inflow region may be unfavorable.

Rib-like projections in the outflow regions are preferred, which preferably extend away from the inflow region and in the direction of an adjacent edge of the heat exchange surface, and whose surfaces, together with the floor of the stretched-out interstices between the projections, form the heat exchange surface within the outflow region, and, as a result of the enlargement of the heat exchange surface, compared to a level surface, make possible an improvement in the heat transfer in the outflow region. The interstices between adjacent projections form flow channels there for the cooling air which, after its deflection in the inflow region, flows along the rib-like projections, that is, essentially in parallel to the upper side of the cooling body, all the way through the outflow region to the adjacent edge of the heat exchange surface.

However, instead of the rib-like projections, in the outflow region, pin-type or needle-type projections may also be provided, these being situated in the flow direction of the cooling air in the outflow region, preferably offset to one another. By an offset of the projections, an improved flow around the projections is achieved, and with that, the surfaces of the projections, along which the cooling air has to flow when passing though the outflow region, are enlarged. The positioning of the projections is expediently selected in such a way that the offset of the projections in two rows, situated one after the other in the flow direction of the cooling air, corresponds to one-half the center-to-center distance of the projections in each row, whereas the distance of the two adjacent rows in the flow direction is expediently equivalent to 0.5 to 1.5 times the center-to-center distance of adjacent projections transversely to the flow direction.

In the outflow region, just as in the inflow region, the pin-shaped or needle-shaped projections expediently have a frustoconically tapered shape starting at their base, the ratio of height to base diameter amounting to about 1.0 to 2.5, while the ratio of base diameter to head diameter amounts to about 1.8 to 2.2. The corresponding also applies for the rib-type projections, when observed in the flow direction of the air.

BRIEF DESCRIPTION OF THE DRAWINGS

The present invention is explained below in more detail with the aid of a few exemplary embodiments and corresponding figures.

FIG. 3 shows a perspective view of a simulation of the application of cooling air to the cooling body as in FIG. 2, according to the present invention.

FIG. 4 shows a simplified schematic upper side view of the cooling body, along with a representation of the inflow and the outflow region.

FIG. 5 shows a simplified schematic sectional view of the cooling body along the line V-V of FIG. 4.

DETAILED DESCRIPTION OF EXAMPLE EMBODIMENTS

Figure 1:
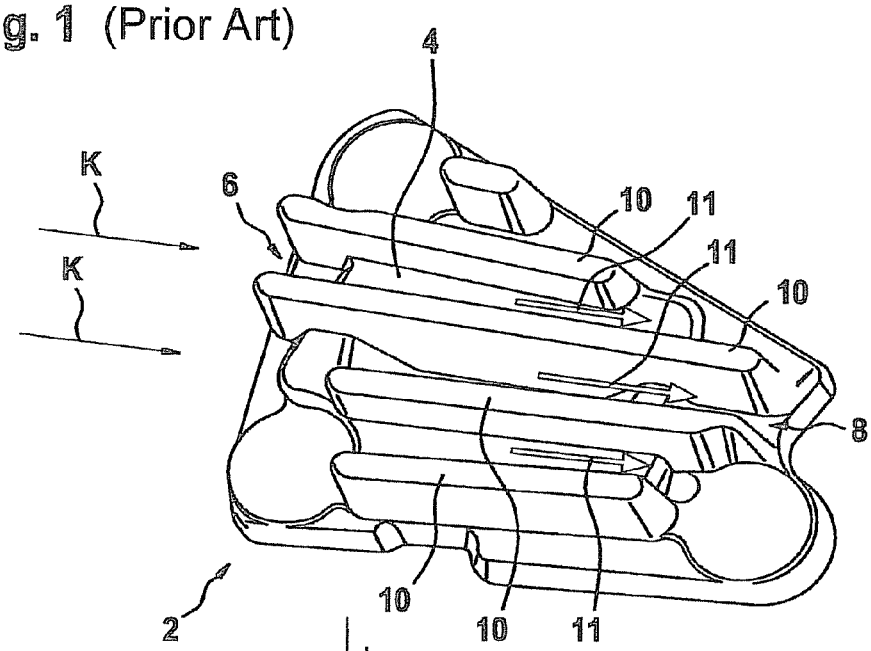
Fig. 1 (Prior Art)
FIG. 1 shows a perspective view of a conventional cooling body for a voltage regulator of a DC generator of a motor vehicle.

Cooling bodies 2, shown in the drawing, that are made of a material having a good thermal conductivity, such as aluminum, are used for mounting on a voltage regulator (not shown) of a DC generator of a vehicle, in the cooling air stream K of a fan of the DC generator.

The conventional cooling body 2 shown in FIG. 1 has cooling air applied to it from one side, in the direction of arrow K, which makes contact with a heat exchange surface 4 on the upper side of cooling body 2 in an inflow region 6 at one side of heat exchange surface 4, and leaves cooling body 2 again in an outflow region at the opposite side of heat exchange surface 4. In order to enlarge heat exchange surface 4 that is in contact with the cooling air stream, cooling body 2 has altogether five smooth cooling ribs 10 that protrude over its upper side, which extend generally in parallel to flow direction K of the cooling air from inflow region 6 to outflow region 8. However, it was determined, in the case of conventional cooling body 2, that in response to the cooling air passing through the flow channels in interstices 12 between adjacent cooling ribs 10, boundary layers form, that have low flow speed, at the walls of cooling ribs 10 and on the floor of interstices 12, and that these impair the convective heat transfer, and with that, the cooling effect of cooling body 2.

Figure 2:
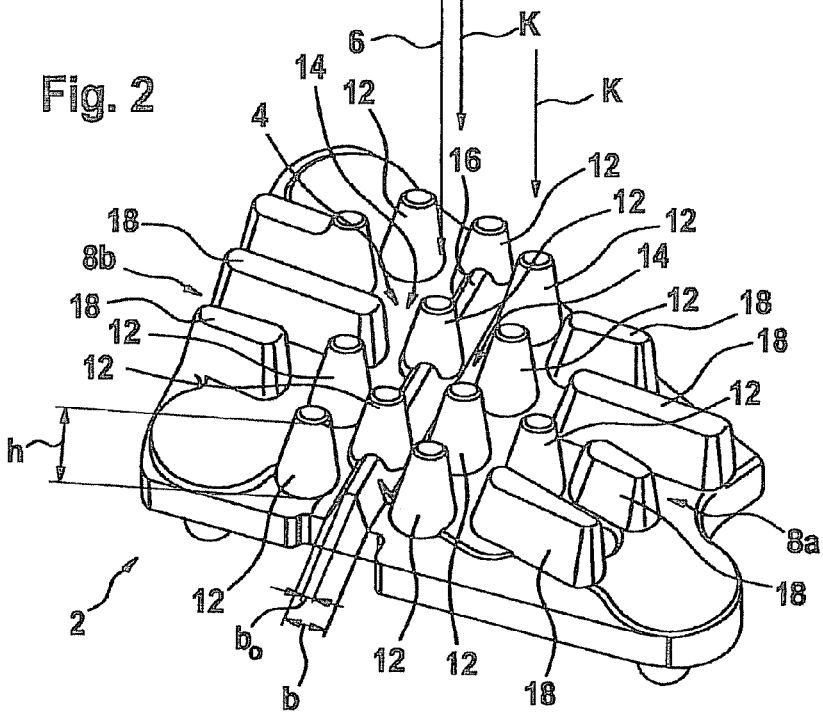
FIG. 2 shows a perspective view of a cooling body for the voltage regulator.

Accordingly, cooling body 2 shown in FIGS. 2 through 6 was developed, whose general outline and outer measurements correspond to those of conventional cooling body 2, but which has cooling air K applied from above, as shown in FIGS. 2 and 3, differently from conventional cooling body 2 which, for one thing, has it applied from the side, and which, for another thing, is shaped differently in inflow region 6 and outflow region 8.

In the case of cooling body 2 shown in FIGS. 2 through 6, the supplied cooling air stream in inflow region 6 lying approximately in the middle of the heat exchange surface impinges in generally a perpendicular manner on the upper side of cooling body 2, where the cooling air is predominantly diverted to two opposite sides of heat exchange surface 4 and then flows generally parallel to the upper side of cooling body 2, through outflow region 8 to the respectively adjacent edge of heat exchange surface 4, as is also shown schematically in FIGS. 4 and 5.

Figure 6:
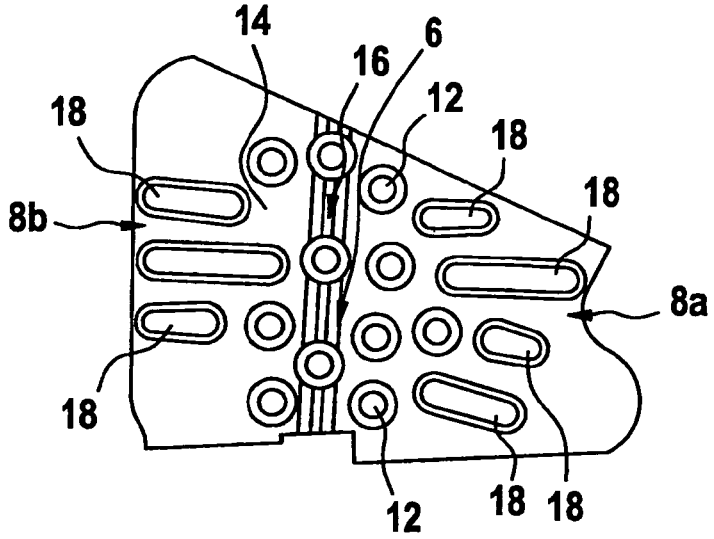
FIG. 6 shows an upper side view of the cooling body.
Figure 7:
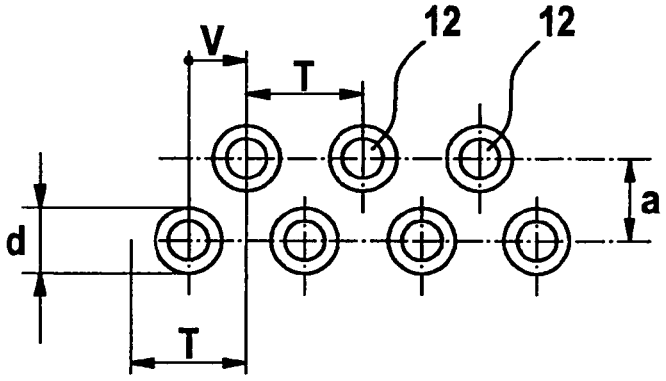
FIG. 7 shows a schematic representation of the arrangement of pin-type or needle-type projections of the cooling body.
Figure 8:
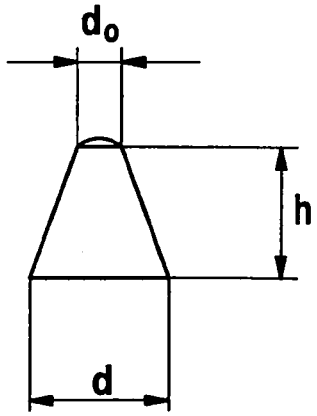
FIG. 8 shows a schematic sectional view of one of the pin-type or needle-type projections.

As is shown in FIGS. 2, 3 and 6, in inflow region 6 cooling body 2 has a plurality of individual pin-type or needle-type projections 12, which, at a distance from one another, protrude above a flow-against surface 14 of inflow region 6 situated between the projections. As shown in FIGS. 2 and 7, projections 12 have a frustoconical shape tapering upwards and having a rounded head, the ratio of height h to base diameter d amounting to about 1.0 to 2.5, while the ratio of base diameter d to head diameter do amounting to about 1.8 to 2.2.

In cooling body 2 shown in FIGS. 2, 3 and 6, inflow region 6 furthermore has a saddle-shaped elevation 16, which extends, approximately in parallel to the opposite shorter edges of heat exchange surface 4, in a straight line over the latter, so that inflowing cooling air K is deflected by two oblique deflection surfaces at the opposite sides of elevation 16, predominantly into two subsections 8*a*, 8*b* of outflow region 8 situated on opposite sides of elevation 16. Consequently, saddle-shaped elevation 16 acts as a flow divider. Elevation 16 is formed so that, in cross section, the ratio of height h to width b of its base amounts to about 0.8 to 1.2, while the ratio of width b of its base to width $b_0$ of its apex amounts to about 2.0 to 4.0, as shown in FIG. 2. A further definition may be undertaken, to the extent that elevation 16 is formed in such a way that the cross section has a ratio of half the height (h_half (h/2) to width b_half at one-half the height of elevation 16 of about 1.1 to 1.5, while the ratio of width b of half elevation 16 at one-half the height h_half to width $b_0$ of its apex amounts to about 1.4 to 1.8. The apex is located in such a way that at straight legs of elevation 16, the latter go over into a rounding of the crest of the elevation (e.g., inflection point or inflection line at the side of the elevation). Above elevation 16, three of the pin-type or needle-type projections 12 protrude at the same distances from one another. On both sides of elevation 16, still within inflow region 6, there is situated in each case a row of pin-type or needle-type projections 12 along elevation 16, at a distance from one another.

Outflow region 8 of cooling body 2 shown in FIGS. 2, 3 and 6 is made up generally of the two subsections 8*a*, 8*b* situated at a distance on both sides of elevation 16, as may be seen in FIG. 2. Outflow region 8 is provided with protruding projections 18 in the form of elongated cooling ribs having rounded apices, which extend in one direction away from elevation 16 to the respective adjacent edge of heat exchange surface 4, adjacent projections 18 possibly diverging slightly, so that a diffuser effect is created by the enlargement of the distance in the direction to the edge of the cooling body, between the cooling ribs. As may be seen especially in the right part of FIG. 3, the major part of the cooling air supplied in inflow region 6 to heat exchange surface 4 flows all the way through interstices 20 between cooling ribs 18, where the temperature of cooling body 2 is higher in comparison to the upper side of cooling ribs 18, so that very good heat dissipation is assured.

It was also established by experimentation that, in the case of cooling body 2 in FIGS. 2, 3 and 6 as well as in inflow region 6 and also in outflow region 8, boundary layers do not form, or form in only a slight measure, and therefore the convective heat transfer is not impaired, or impaired only to an unimportant extent. On the inside of the voltage regulator provided with cooling body 2 of FIGS. 2, 3 and 6, one was therefore able to measure, in the regions having the highest temperature, a temperature reduction by approximately 5 degrees Kelvin, compared to a voltage regulator having the cooling body 2 of FIG. 1.

In the place where, other than shown in the figures, on both sides of saddle-shaped elevation 16 several rows of pin-type or needle-type projections 12 are situated in the flow direction of the cooling air, one after the other, in the inflow region and/or the outflow region, projections 12 in these rows are offset to one another transversely to the flow direction of the cooling air, at least in outflow region 8. As is shown in FIG. 6, in this case offset V corresponds approximately to one-half of center-to-center distance T of projections 12 of each row, while distance a between the rows amounts to about 0.5 to 1.5 times center-to-center distance T.

Moreover, it is further provided, see also FIG. 6, that the axes of symmetry, or center lines of the pin-type or needle-type projections 12 standing in one row and flow direction, and perhaps of rib-type projections 18, are situated slightly offset from one another, so that the formation of laminar boundary layers is impeded and thus the cooling effect is improved.

In this embodiment, a "DC generator" means that a DC voltage may be measured at the current output of the generator during operation. This may naturally also be the current output after a rectifier which has rectified an alternating current voltage or a three-phase current voltage.

What is claimed is:

1. A regulator, comprising:

a cooling body for an electric machine including a heat exchange surface to which a cooling air stream may be applied during operation of the electric machine, the cooling body having an inflow region in which the cooling air stream impinges upon the heat exchange surface, and an outflow region from where the cooling air stream leaves the heat exchange surface;

wherein:

the inflow region includes a saddle-shaped elevation, which has at least two deflecting surfaces that are aligned obliquely to a direction of incoming cooling air and point in a direction of adjacent subsections of the outflow region disposed on opposite sides of the elevation;

the outflow region includes a plurality of rib-shaped projections and a plurality of pin-shaped or needle-shaped projections disposed in each said subsection of the outflow region located between the saddle-shaped elevation and the rib-shaped projections;

each of the rib-shaped projections extends linearly along a plane of the heat exchange surface, away from the inflow region and towards an adjacent edge of the heat exchange surface, adjacent ones of the rib-shaped projections forming channels through which air deflected by one of the at least two deflecting surfaces is directed outward toward a respective adjacent edge; and adjacent ones of the pin-shaped or needle-shaped projections are offset to each other along directions of deflected air flow.

2. The regulator as recited in claim 1, wherein the inflow region is situated centrally on the heat exchange surface, and the outflow region one of: i) at least partially surrounds the inflow region, or ii) is situated on both sides of the inflow region.

3. The regulator as recited in claim 1, wherein the heat exchange surface in the inflow region includes a flow-against surface that is planar and is aligned perpendicular to a direction along which the cooling air is applied.

4. The regulator recited in claim 1, wherein the saddle-shaped elevation has a convexly curved upper side.

5. The regulator as recited in claim 1, wherein an additional plurality of protruding pin-shaped or needle-shaped projections are situated within the inflow region.

6. The regulator as recited in claim 5 wherein at least some of the additional plurality of pin-shaped or needle-shaped projections are situated at a distance from one another at least one of i) along the saddle-shaped elevation, and ii) on both sides of the saddle-shaped elevation.

7. The regulator as recited in claim 1, wherein the pin-shaped or needle-shaped projections are offset to adjacent ones of the rib-shaped projections along the directions of deflected air flow.

8. An electric machine including a regulator, the regulator comprising:

a cooling body including a heat exchange surface to which a cooling air stream may be applied during operation of the electric machine, the cooling body having an inflow region in which the cooling air stream impinges upon the heat exchange surface, and an outflow region from where the cooling air stream leaves the heat exchange surface;

wherein:

the inflow region includes a saddle-shaped elevation, which has at least two deflecting surfaces that are aligned obliquely to a direction of incoming cooling air and point in a direction of adjacent subsections of the outflow region disposed on opposite sides of the elevation;

the outflow region includes a plurality of rib-shaped projections and a plurality of pin shaped or needle-shaped projections disposed in each said subsection of the outflow region located between the saddle-shaped elevation and the rib-shaped projections;

each of the rib-shaped projections extends linearly along a plane of the heat exchange surface, away from the inflow region and towards an adjacent edge of the heat exchange surface, adjacent ones of the rib-shaped projections forming channels through which air deflected by one of the at least two deflecting surfaces is directed outward toward a respective adjacent edge; and adjacent ones of the pin-shaped or needle-shaped projections are offset to each other along directions of deflected air flow.

* * * * *

UNITED STATES PATENT AND TRADEMARK OFFICE

CERTIFICATE OF CORRECTION

PATENT NO. : 8,371,364 B2
APPLICATION NO. : 12/226697
DATED : February 12, 2013
INVENTOR(S) : Braun et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1064 days.

Signed and Sealed this
First Day of September, 2015

Michelle K. Lee

Michelle K. Lee
*Director of the United States Patent and Trademark Office*